US005355951A

United States Patent [19]

Allen et al.

[11] Patent Number: 5,355,951

[45] Date of Patent: Oct. 18, 1994

[54] METHOD OF EVALUATING OIL OR GAS WELL FLUID PROCESS

[75] Inventors: Thomas E. Allen; Gary D. Arnold; Leonard R. Case; Mark A. Clark; Gary E. Folmnsbee; Jerry L. Gammill; James M. Macadam; John M. Richardson; Freddie L. Sabins; Larry T. Watters, all of Duncan, Okla.

[73] Assignee: Halliburton Company, Duncan, Okla.

[21] Appl. No.: 31,777

[22] Filed: Mar. 15, 1993

[51] Int. Cl.[5] ..... E21B 33/13; E21B 44/00; E21B 47/06

[52] U.S. Cl. ..... 166/250; 166/53; 166/253; 166/285

[58] Field of Search ..... 166/53, 250, 253, 285; 364/422

[56] References Cited

U.S. PATENT DOCUMENTS 4,432,064 2/1984 Barker et al. ..... 364/422 X
4,571,993 2/1986 Onge ..... 364/422 X
4,845,981 7/1989 Pearson ..... 166/250 X
4,953,618 9/1990 Hamid et al. ..... 166/53 X

OTHER PUBLICATIONS

"Parameters to Measure in the Cementing Process", S.I.P.M. Workshop, R. Simard, (1991).
"Cementing as a Total Service", IADC/SPE 23898, R. D. Stilley & J. E. Griffith, (1992).

*Primary Examiner*—George A. Suchfield
*Attorney, Agent, or Firm*—Robert A. Kent; Thomas R. Weaver; E. Harrison Gilbert

[57] ABSTRACT

A method of evaluating a slurry mixing and placing process, such as a cementing process, for an oil or gas well comprises identifying and measuring specific subprocesses and parameters thereof, statistically summarizing the parameters and creating a database thereof, and analyzing the statistically summarized parameters to identify or compare against process capabilities to reduce variation, thereby improving specific job performance and the overall process.

9 Claims, 11 Drawing Sheets

METHOD OF EVALUATING OIL OR GAS WELL FLUID PROCESS

BACKGROUND OF THE INVENTION

This invention relates generally to methods of evaluating a process of mixing and placing a fluid for oil or gas wells and more particularly to a method of evaluating a cementing process for oil or gas wells.

During the creation of an oil or gas well, various mixtures are typically blended and pumped into the well. For example, a cement slurry of at least water and cement is mixed at the well and pumped into it such as for securing a casing or liner in the bore. As another example, a slurry of at least a base fluid and sand is mixed at the well and pumped into it as a fracturing fluid for hydraulically fracturing a subterranean formation and propping the created fractures open with the sand to facilitate oil or gas flow from the formation into the well. These, and other fluids such as acids, for example, are handled at well sites and placed in wells; however, only cement and the cementing process will be referred to throughout the remainder of this disclosure.

Historically, the ability to quantitatively evaluate the quality of a cementing operation has been limited. When the designing, mixing and placing of cement slurry downhole has been evaluated, it has typically involved using qualitative or semiquantitative design parameters, rules of thumb, inherently variable material and variations of mixing equipment with virtually undocumented performance characteristics. Causes of failure occurring during placement have historically been almost impossible to definitively analyze. When cement has been successfully placed, operators have resorted to indirect acoustic methods to evaluate the expected performance of the cement sheath. The major evaluation method has, however, remained based on qualitative or semiquantitative wellbore performance acceptability criteria. Although cementing has been used for over 70 years in the oil and gas industry, the overall cementing process has not been critically analyzed in a manner whereby causes or modes of failure could be usefully evaluated in a concise manner or whereby both individual and overall cementing process quality could be assured or improved in a consistent and quantitatively defined manner.

Aside from a basic desire to understand the cementing process more fully and to assure that a quality cementing process is being provided to customers, there is also the need for an improved method of evaluating and improving the cementing process for oil or gas wells due to national and international quality assurance standards that exist today. For example, in Europe companies may have to comply with standards such as the ISO 9000 series of the International Organization for Standardization. When these companies are service users, they may be required to use only quality service providers who also comply with such standards. Thus, there is the need for an improved method of evaluating a process of mixing and placing a fluid, such as a cement slurry, for oil or gas wells so that more effective quality assurance and improvement can be obtained and further whereby specific standards can be readily met.

SUMMARY OF THE INVENTION

The present invention overcomes the above-noted and other shortcomings of the prior art and meets the needs stated above by providing a novel and improved method of evaluating a process of mixing (or otherwise handling) and placing a fluid, such as a cement slurry, for oil or gas wells. Such a method enables the quantification of performance, the identification of problem areas, and the elucidation of subprocesses and interactions among them and of ways to obtain process improvement. This allows more effective quality assurance and improvement to be obtained; and it also allows specific quality standards, whether specific job specifications or more general requirements, to be readily met. Thus, both particular job evaluation and overall process evaluation can be obtained with the present invention.

In one aspect, the method of evaluating a cementing process for an oil or gas well comprises: identifying subprocesses of a cementing process; expressing the identified subprocesses in a visual medium, including visually linking each subprocess to at least one other subprocess; performing identified subprocesses to implement an actual cementing process at an oil or gas well, including mixing a cement slurry, placing the cement slurry in the well and monitoring operating parameters of the performed subprocess so that electrical signals representing the monitored parameters are generated; creating in a computer a database in response to the generated electrical signals, wherein the database includes data from the actual cementing process related to the linked identified subprocesses; and analyzing data from the database for determining whether any identified subprocess as actually performed is causative of a problem in the actual cementing process.

In a further aspect the method of evaluating a cementing process for an oil or gas well comprises: defining linked subprocesses of a cementing process for an oil or gas well; creating flow charts of the linked subprocesses; listing quality characteristics of each subprocess; creating a database in a computer, wherein the database includes data corresponding to quality characteristics of the cementing process and obtained by actually performing the cementing process at a plurality of oil or gas wells; and analyzing the cementing process performed for a particular oil or gas well, including identifying to the computer the particular well, identifying to the computer evaluation criteria to be used, and automatically comparing in the computer selected quality characteristics stored in the database for the particular well with corresponding identified evaluation criteria.

Without being limited to a cementing process in its broader aspects, the present invention is also defined as a method of evaluating a process of mixing and placing a fluid at an oil or gas well, comprising: measuring a plurality of operating parameters during a process of mixing and placing a particular fluid at a particular oil or gas well; storing data representing the measured parameters; statistically summarizing the stored data in a computer; storing, in a format predetermined by quality characteristics of the fluid mixing and placing process, the statistically summarized data in a database of statistically summarized data maintained in the computer; and analyzing the statistically summarized data in at least one analytical category predetermined by the quality characteristics of the fluid mixing and placing process.

The present invention can also be defined as a method of improving quality of a cementing process for oil or gas wells, comprising: defining subprocesses of a generic cementing process for oil or gas wells, defining measurable quality characteristics of the subprocesses and defining operating specifications for a plurality of stages of a particular cementing process; mixing and pumping stages of cement slurry in an oil or gas well in response to the defined operating specifications; generating electrical signals in response to measuring actual cementing process conditions, including density, existing during the mixing and pumping of the cement slurry and corresponding to the defined measurable quality characteristics; transforming the electrical signals into data, including defining groups of raw data in response to the electrical signals and selected time markers applied thereto and computing summarized data from the raw data within each of the defined groups; and displaying a quantified job result report enumerating the volume percentage of stages of the particular cementing process having actual density within a predetermined variance of a desired density for each stage defined in the operating specifications.

In another aspect the method of improving quality of a cementing process for oil or gas wells comprises: defining subprocesses of a cementing process for oil or gas wells and defining measurable quality characteristics of the subprocesses; mixing and pumping cement slurry in an oil or gas well, including implementing defined subprocesses in response to a predetermined operating specification; generating electrical signals in response to measuring actual cementing process conditions existing during the mixing and pumping of the cement slurry and corresponding to the defined measurable quality characteristics; transforming the electrical signals into data, including defining groups of raw data in response to the electrical signals and selected time markers applied thereto and computing summarized data from the raw data within each of the defined groups; storing the summarized data in a database of a computer; and computing a cementing process capability in response to the stored summarized data and the predetermined operating specification.

Therefore, from the foregoing, it is a general object of the present invention to provide a novel and improved method of evaluating a process of handling (such as, particularly, mixing) and placing a fluid at an oil or gas well, such as a cementing process. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 6 is a flow chart of an abort job subprocess of the cementing process.

DETAILED DESCRIPTION OF PREFERRED EMBODIMENTS

Although at least some aspects of the present invention are applicable to evaluating processes of handling and pumping fluids at oil or gas wells in general, the preferred embodiment of the present invention will be described specifically as a method of evaluating a cementing process for an oil or gas well where a cement slurry is mixed and pumped at the well site. One type of cement mixing and pumping system that can be used for implementing this preferred embodiment is represented in FIG. 1.

Figure 1:
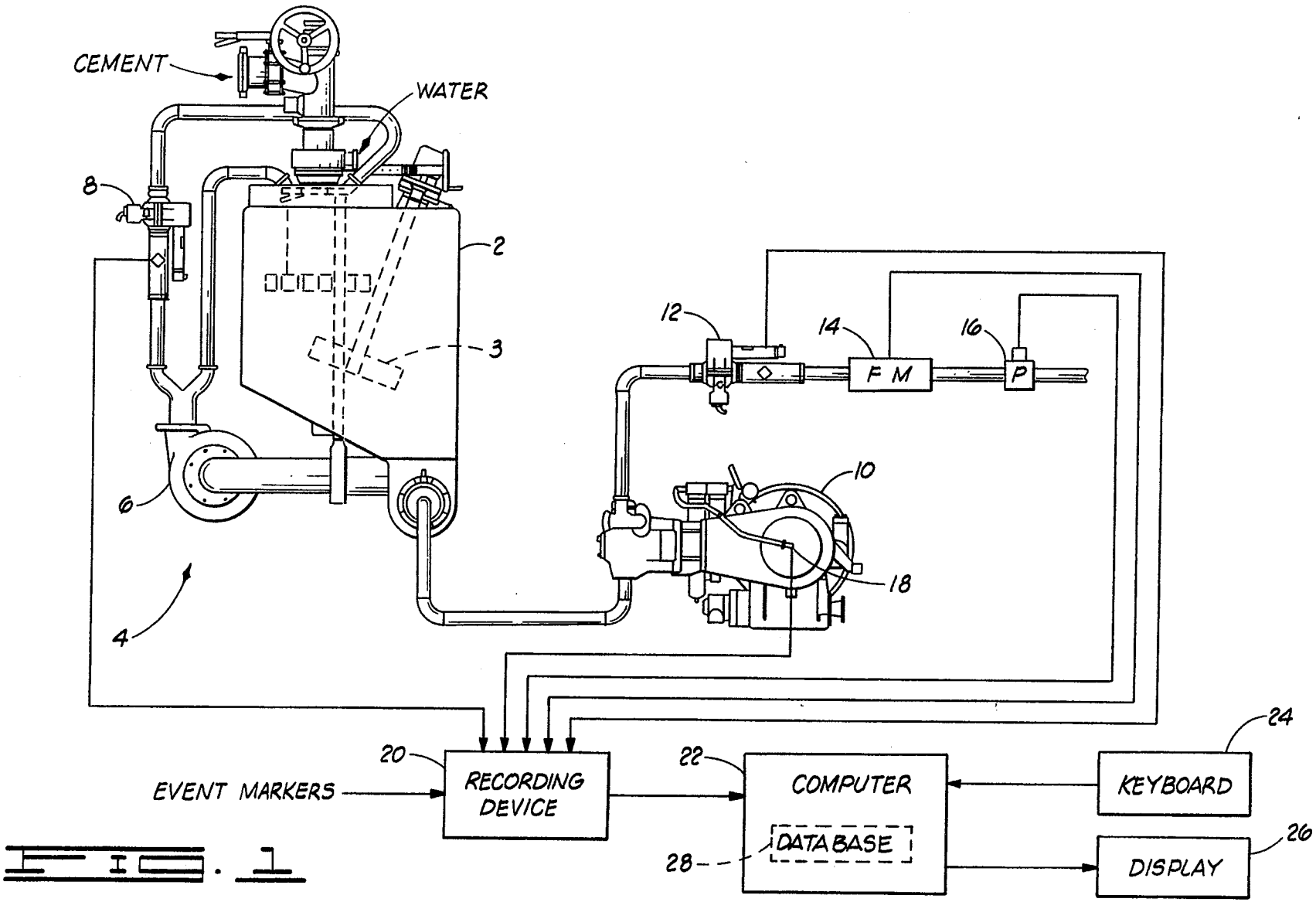
FIG. 1 is a functional block and schematic representation of a cement slurry mixing and pumping system that can be used in the method of the present invention.

Referring to FIG. 1, a mixing tub 2 receives water and cement flows from suitable sources as known in the art. The input flows are mixed by their own energy and by mechanical energy added by an agitator 3. The tub 2 typically has at least two compartments separated by a weir (not shown) over which mixture flows to help reduce air entrainment. Part of the mixing subprocess of the overall cementing process also includes recirculating at least part of the contents of the tub 2 through a recirculation circuit 4 having a pump 6 and a densimeter 8.

To place a cement slurry from the tub 2 into the well, a pump 10 pumps the slurry from the tub 2 through an outlet line in which a densimeter 12, a flow meter 14 and a pressure transducer 16 are disposed. A stroke counting device 18 is connected to the pump 10.

The sensing or measuring devices 8, 12, 14, 16, 18 convert sensed operating parameters or characteristics of an actual cementing process into electrical signals that are provided to a recording device 20, such as a "COMPUPAC" or "UNI-PRO II" computer from Halliburton Services of Duncan, Okla. The recording device 20 is typically located in the field at the well site where the mixing and pumping occur.

All these features of the cement mixing and pumping system shown in FIG. 1, and how they work, are known in the art.

The system just described is typically used in a known manner to sequentially produce and place in an oil or gas well a series of different types of cement slurries and spacer fluids. Each of the respective volumes of slurry or fluid is referred to as a stage, having a beginning time and an ending time. There is also a transition time from one stage to the next, during which density changes from one desired level to another desired level typically are to occur as known in the art.

Also shown in FIG. 1 is a computer 22 having peripheral devices connected to it, such as (1) a keyboard 24 for enabling a human operator to communicate to the computer 22 and (2) a display 26 (e.g., a monitor or printer or both) through which the computer 22 can communicate to the human operator. An example of a suitable computer 22 is at least a 386SX IBM compatible personal computer with a 2-Meg RAM and a 40-Meg hard drive. The computer 22 is typically located remotely from the well site, such as at a central office; however, it could be located in the field or even combined with the recording device 20.

Figure 2:
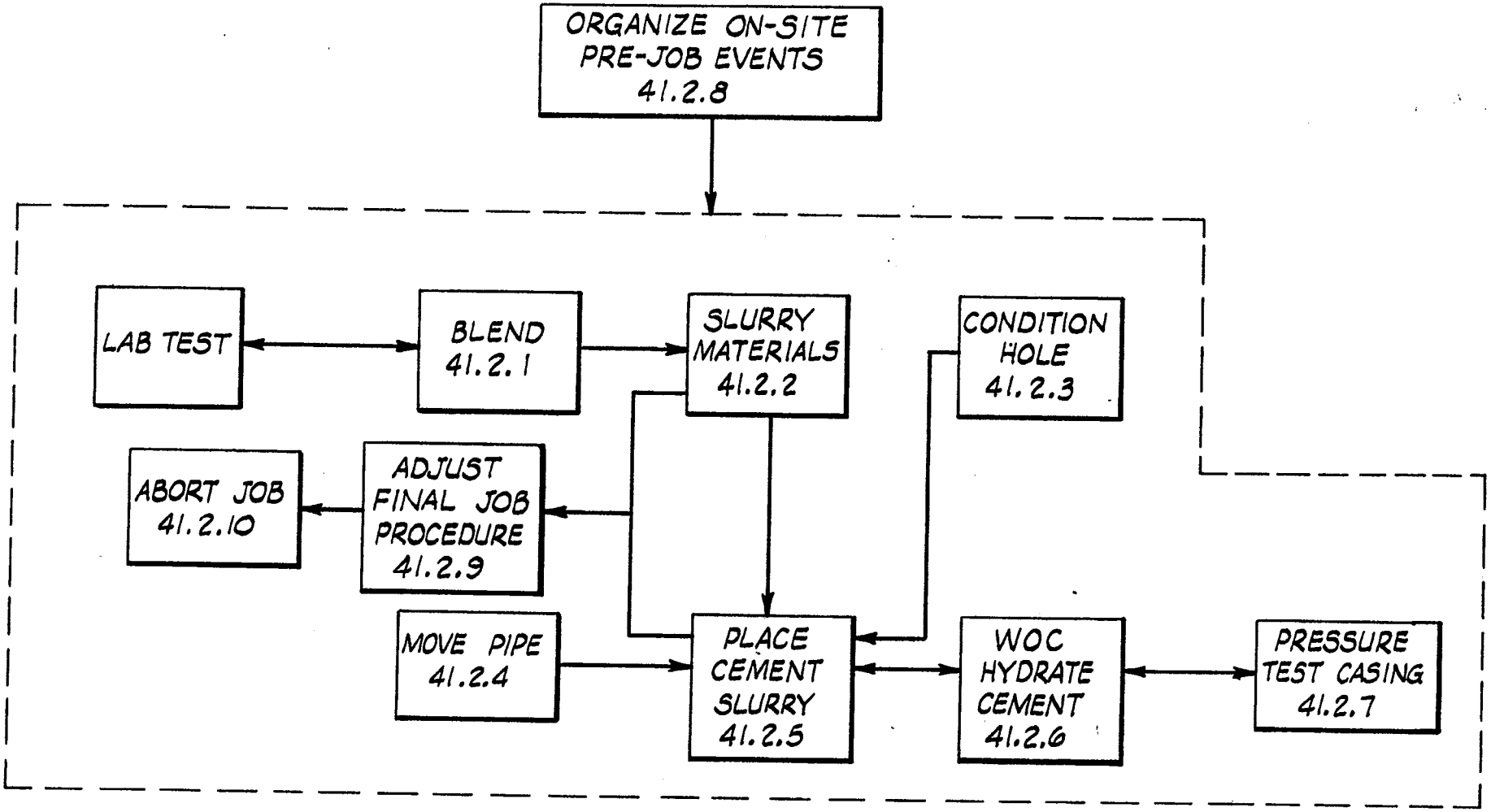
FIG. 2 is a visual representation of a linkage-of-process definition of a cementing process for the preferred embodiment of the present invention.

To evaluate a cementing process, such as one that uses the cement mixing and pumping system shown in FIG. 1, in accordance with the present invention, whereby the quality of the cementing process can be assured and improved as needed, subprocesses of the overall cementing process are first identified. Referring to FIG. 2, we have identified the following subprocesses as constituting a generic cementing process as performed by Halliburton Services: blend (41.2.1), slurry materials (41.2.2), condition hole (41.2.3), move pipe (41.2.4), place cement slurry (41.2.5), wait-on-cement/hydrate cement (41.2.6), pressure test casing (41.2.7), organize on-site pre-job events (41.2.8), adjust final job procedure (41.2.9), and abort job (41.2.10) (the numbers in the parentheses are arbitrary numerical identifiers that facilitate overall organization).

These subprocesses are linked together as indicated in FIG. 2. Such linkage-of-process graphically describes the customer-supplier relationship between the output of one subprocess and the subprocesses which use that output. In identifying these linked subprocesses, flow charts of respective subprocesses are created to graphically illustrate the detail of activity within the subprocesses. A subprocess flow chart describes a time-sequenced series of subprocess actions and decision points required to accomplish the subprocess.

Using a qualitative analytical tool known as the Model to Improve Quality, a subprocess is defined and documented by specifying inputs, operations, outputs, process owners, process customers, quality characteristics and operational definitions. "Quality characteristics" describe parameters or characteristics of the output of the subprocess. Quality characteristics preferably can be measured to assess the performance of the subprocess. In cases where measurements are difficult to determine, such as "on time", "cold", etc., "operational definitions" are used to develop and provide communicable meaning to quality characteristics. Development of operational definitions requires the establishment of a method of measurement or test, a criteria for judgment, and should be usable and practical to apply within the bounds of the subprocess.

Also to be defined are operating specifications for a plurality of stages of a particular cementing process. Such specifications are developed in a known manner to define the criteria by which a particular cementing process is to be implemented and judged.

More details of the identified subprocesses are given in the following sections.

Blend (41.2.1)

The blend subprocess pertains to the blending of all solid materials both at the bulk plant and on location prior to the slurry materials subprocess.

Slurry Materials (41.2.2)

Figure 3:
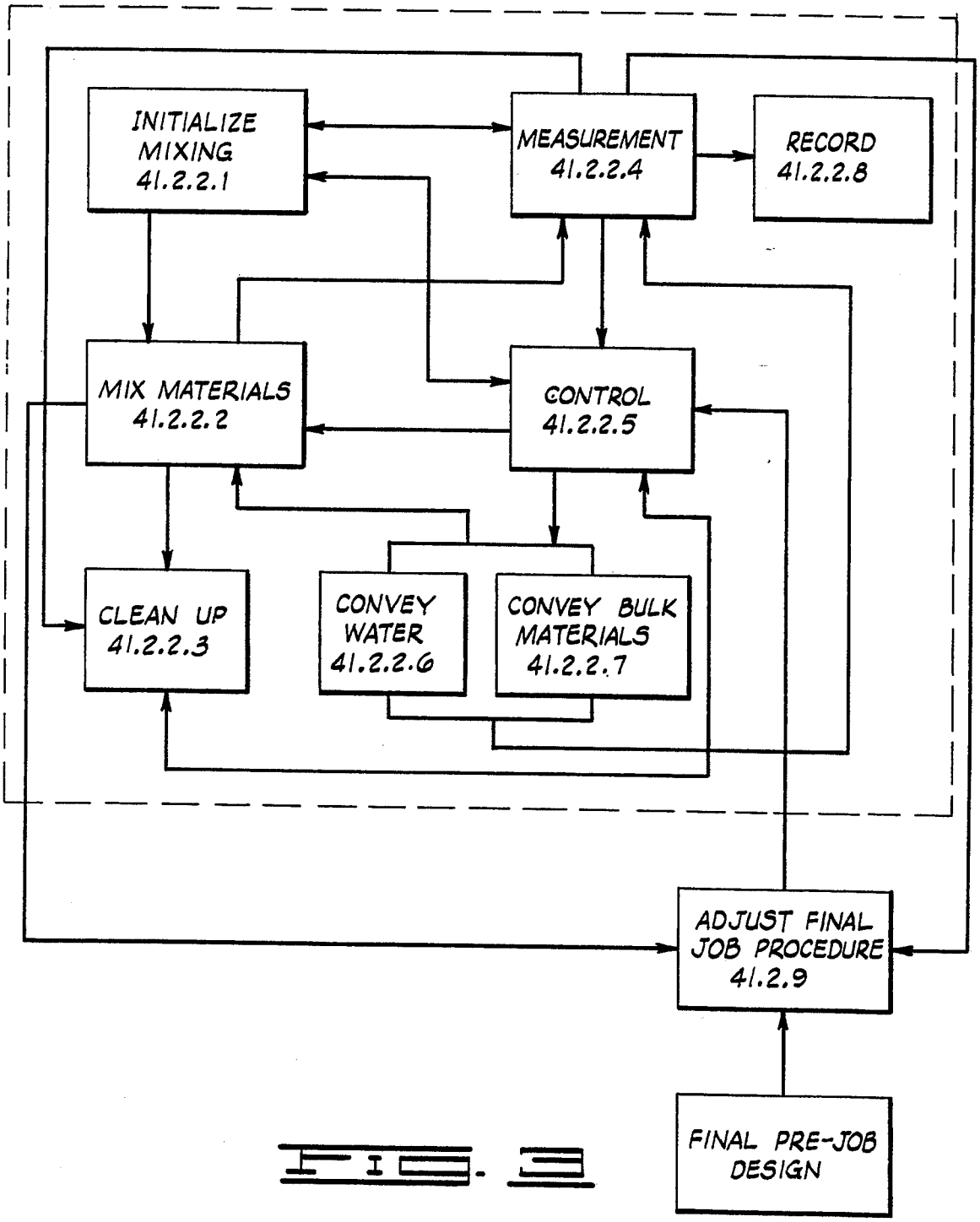
FIG. 3 is a visual representation of a linkage-of-process definition of a slurry materials subprocess of the cementing process.

The slurry materials subprocess has the further linked subprocesses that are identified in FIG. 3. These further subprocesses are described in the following paragraphs.

initialize mixing (41.2.2.1)

During the initialize mixing subprocess, the determination is made as to whether the mixing water and bulk material delivery rates are adequate. The following parameters can be monitored: recirculating pump pressure and drive engine speed, tub level, agitator speed, density and slurry consistency.

mix materials (41.2.2.2)

The mix material subprocess is further divided into a homogenized, apply energy, etc. subprocess and a sampling subprocess. In the former, a determination is made as to whether the agitator is operating properly and the following conditions can be monitored: tub level, recirculating pump pressure and drive engine speed, and slurry consistency. In the latter, the parameters to be sampled are identified, as is the technique to be used in the sampling; additionally, the sampling results are properly documented.

clean up (41.2.2.3)

The clean up subprocess pertains to cleaning up the mixing and pumping equipment, cleaning up the bulk equipment, and cleaning up the site.

measurement (41.2.2.4)

The measurement subprocess verifies whether the required measurements are known and whether all instruments have been activated and calibrated. All the measuring systems are monitored and appropriate recordings are made.

control (41.2.2.5)

The control subprocess is defined by a number of further subprocesses. A control pre-mix density subprocess is used to add water to the tub, recirculate, agitate, and then add cement.

During a control pumping rate subprocess, it is determined whether the required pumping rate and allowable variations are known.

A control mixing rate and density subprocess determines whether required densities and acceptable variations are known, whether the mixing rate is known, and whether the mixing rate is maintained within a predetermined allowable variation.

A control for air entrainment subprocess determines indications of air entrainment, monitors tub level with respect to the agitator, and determines if a defoamer can be added if necessary.

A control pumping pressure subprocess determines whether a maximum allowable pumping pressure is known and whether a desired pumping pressure and variation are known.

A control agitator speed subprocess monitors mixing and appropriate tub level.

A control recirculating pump subprocess determines a minimum recirculating pump pressure and monitors pump speed.

convey water (41.2.2.6)

During the convey water subprocess, displacement tanks are filled if mix water is to be measured and adequate flow is maintained.

convey bulk materials (41.2.2.7)

During this subprocess, an adequate supply of bulk material (e.g., cement) is maintained.

record (41.2.2.8)

During this subprocess, the job parameters to be recorded are determined, the recording devices are powered up and initialized, and all special events are recorded.

Condition Hole (41.2.3)

The condition hole subprocess is not an activity that occurs during the mixing and placing subprocesses; it occurs before, and it provides information about the nature of the wellbore into which the cement is to be pumped. Important quality characteristics of this subprocess include: hole inclination, depth and size; mud type and properties used during drilling; casing and attachments, time and job design; formation characteristics such as temperature and formation fluids; and flow rate and spacers. Operational definitions related to these quality characteristics include: "standoff" describes the eccentricity of the casing with respect to the hole; "pipe movement" describes deliberate movement of the casing during the hole conditioning or cementing process; "lost circulation" describes the amount of drilling mud that is lost to formations either during static or dynamic conditions; "mud type" describes the generic nature of mud in the hole; "time" describes the time allocated to the hole conditioning process; "casing surface" describes the condition of the exterior surface of the casing to be cemented; "casing attachments" describe those attachments that are attached to the casing and that are designed to improve hole conditioning, mud removal, filter cake removal, casing standoff, mud displacement, cement bonding, cement placement and zonal isolation; "flow rate" describes the flow rate of the mud being circulated; "circulatable hole" describes the actual volume of mud being circulated against the actual volume of the hole less any tubulars left in the hole; "spacers" describe the volume, density and generic nature of any fluids used as a spacer between the mud in the hole and the cementing fluid to be introduced; "mud properties" describe the properties of the mud in the hole both before and during the hole conditioning process; and "cement properties" describe the properties of the cement fluid to be introduced into the hole after the hole conditioning process.

Move Pipe (41.2.4)

The move pipe subprocess refers to the action of rotating or reciprocating the casing in the well while circulating fluid either prior to or during the place cement subprocess.

Place cement slurry (41.2.5)

Figure 4:
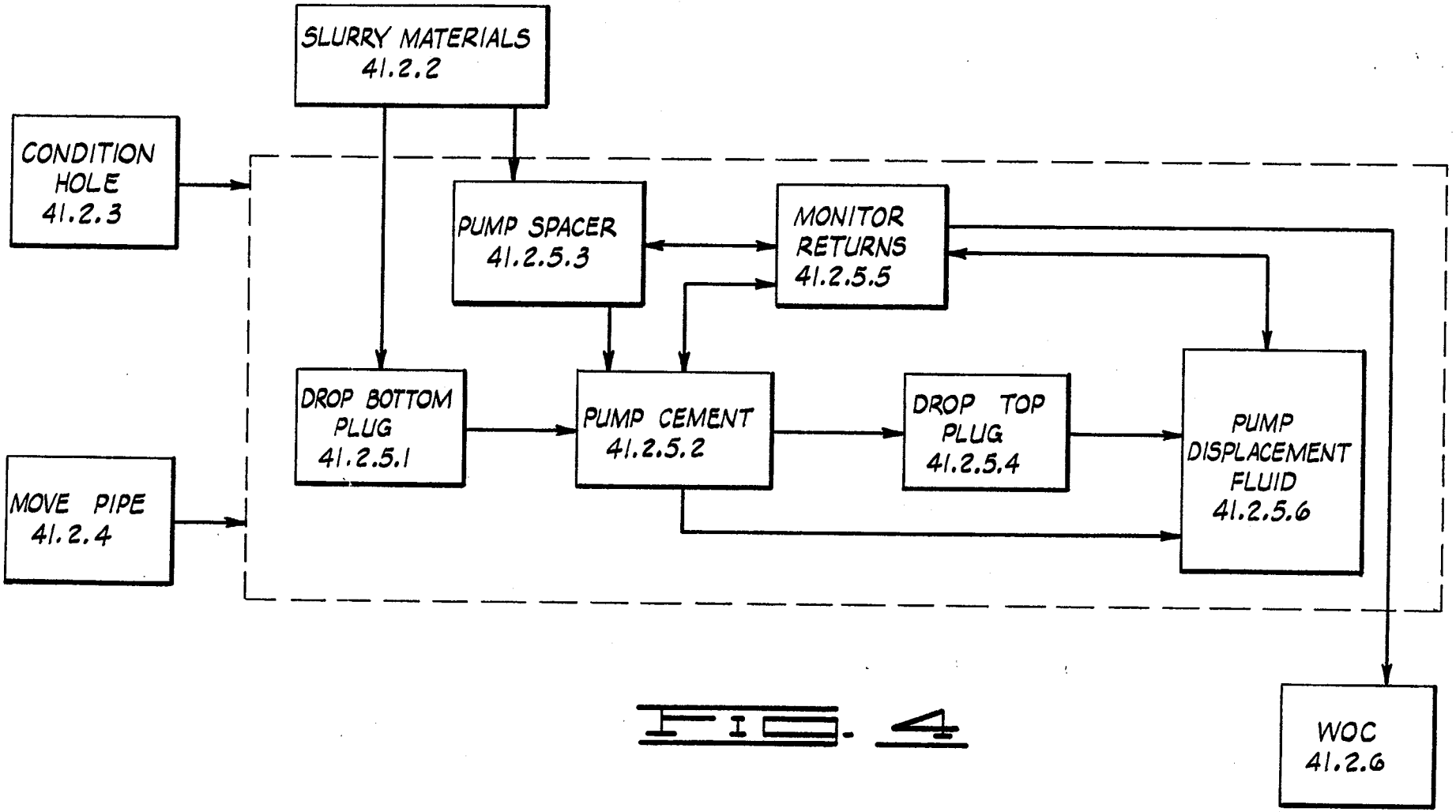
FIG. 4 is a visual representation of the linkage-of-process definition of a place cement slurry subprocess of the cementing process.

The place cement slurry subprocess is defined by the further subprocesses as shown in FIG. 4 and defined in the following paragraphs.

release bottom plug (41.2.5.1)

During this subprocess, it is determined whether the bottom plug(s) has been loaded properly and is of the right size. Verification that the plug container is the right size and rating is also made, and release is confirmed via the appropriate indicator.

pump cement (41.2.5.2)

During this subprocess, it is determined whether the pump is adequate for the designed pumping rate and whether the pump is primed for pumping. If so, the pump is started and the pump rate and pressure are monitored. Cement volumes are recorded and a determination is made as to whether the correct amount of cement volume has been pumped.

pump spacer (41.2.5.3)

During this subprocess, the pump rates and pressures are monitored and the spacer volume is recorded to determine whether the correct amount of spacer volume has been pumped.

release top plug (41.2.5.4)

This subprocess confirms release via checking the appropriate indicator.

monitor returns (41.2.5.5)

During this subprocess, determinations are made as to whether the return line is instrumented, whether the return rates are consistent with the design, whether the total volume is consistent with the design, and whether there were any lost returns or excess returns.

pump displacement fluid (41.2.5.6)

A determination is made as to whether the pump is adequate for the designed pump rate of the displacement fluids. If so, the pump is commenced and the pump rate and pressure are monitored and the displacement volume is recorded. A determination is made as to whether the proper flow is established between the holding tank and the displacement tank. The pump rate is decreased before the top plug lands and a determination is made as to whether the top plug has landed.

Wait-on-Cement/Hydrate Cement (41.2.6)

The WOC/hydrate cement subprocess involves allowing the cement slurry properly placed into the annulus to remain static sufficiently long to hydrate (harden).

Pressure Test casing (41.2.7)

This subprocess determines or confirms integrity of the casing cemented in the hole as well as the annular seal at the point where the casing terminates in the hole. Hydraulic pressure is applied to the casing to a predetermined limit.

Organize On-Site Pre-job Events (41.2.8)

This subprocess includes events such as the arrival of equipment, materials and personnel on the oil or gas well construction site that occur prior to slurry preparation.

Adjust Final Job procedure (41.2.9)

Figure 5:
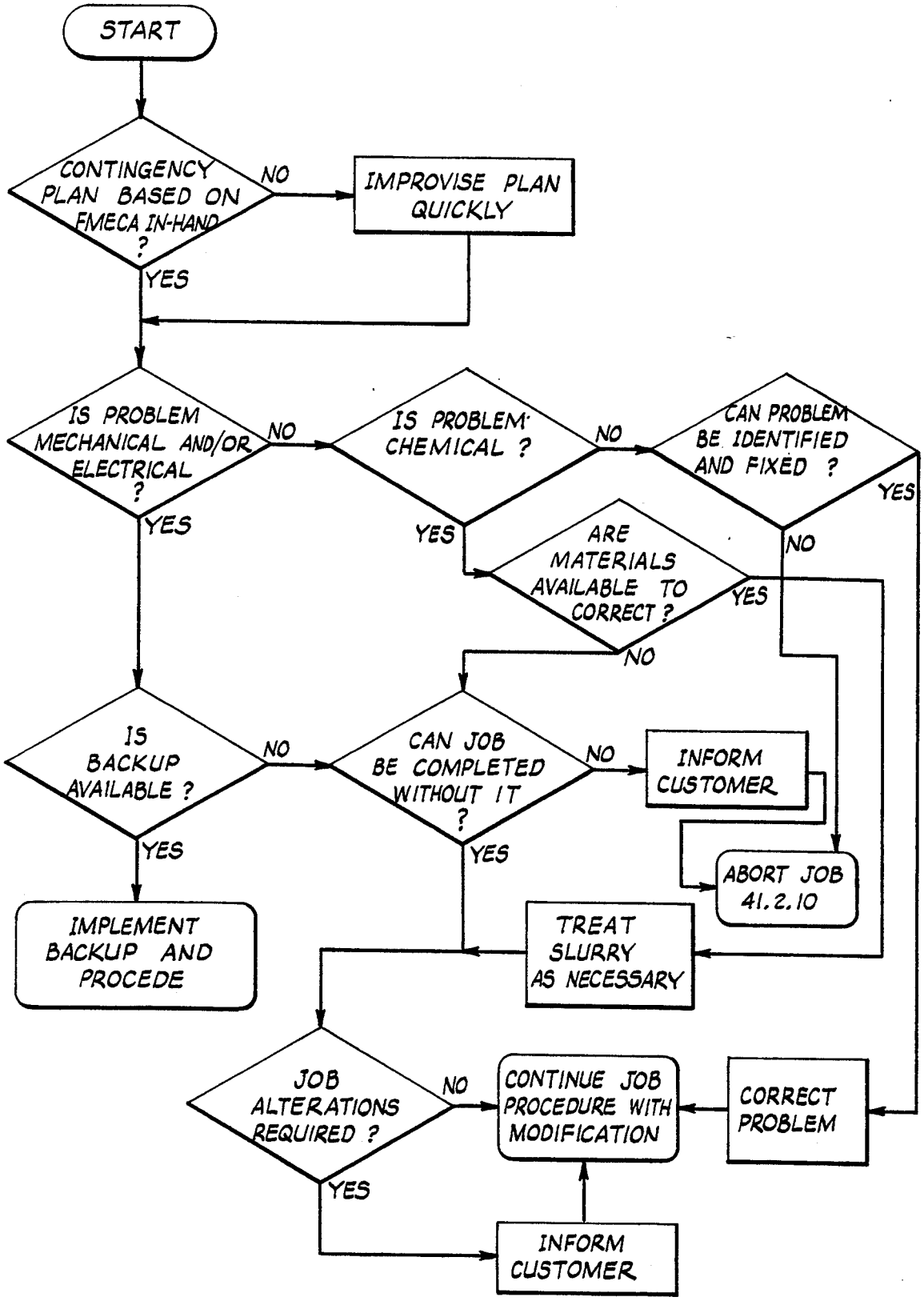
FIG. 5 is a flow chart of an adjust job procedure subprocess of the cementing process.
Figure 5:
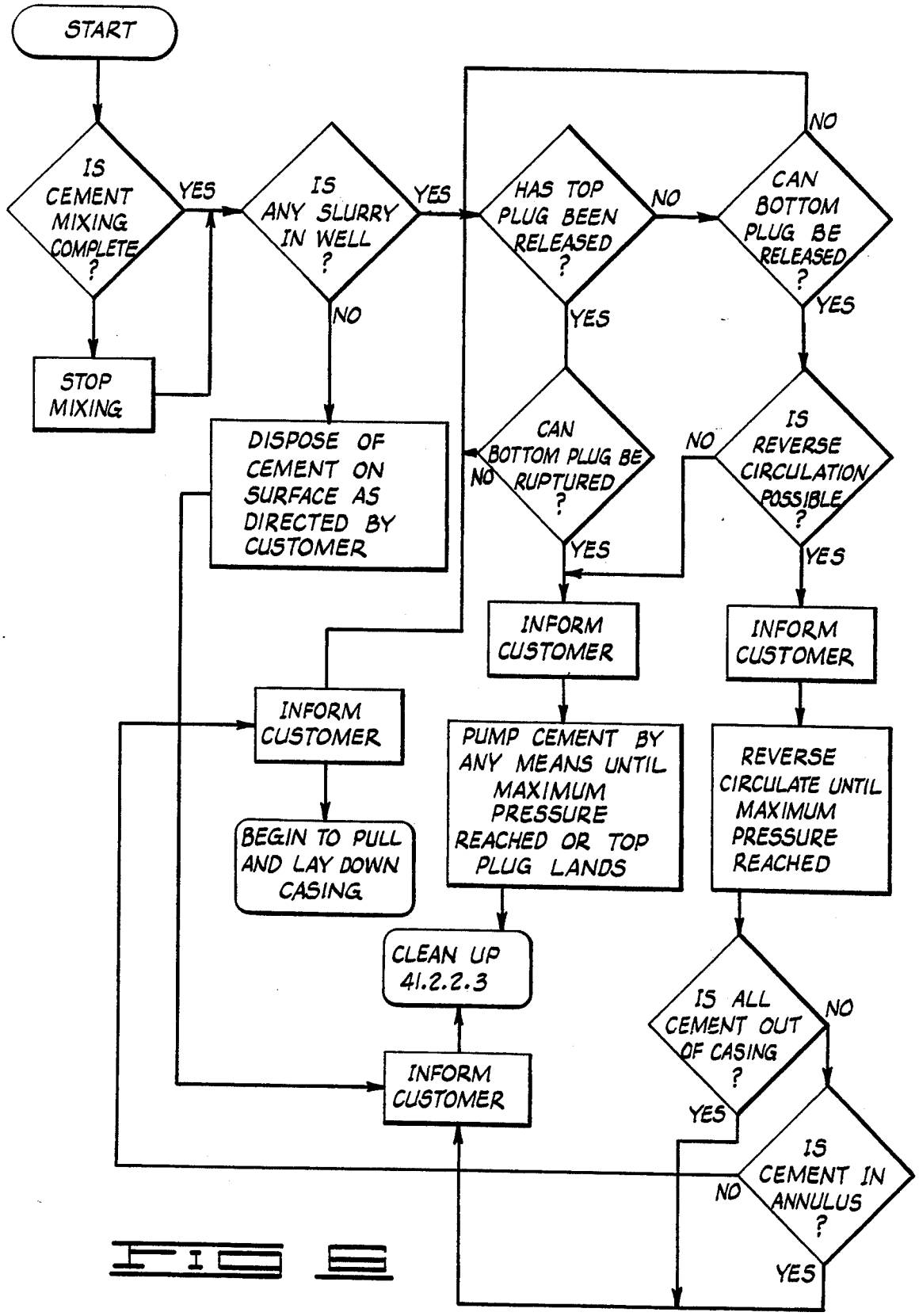
Figure 7:
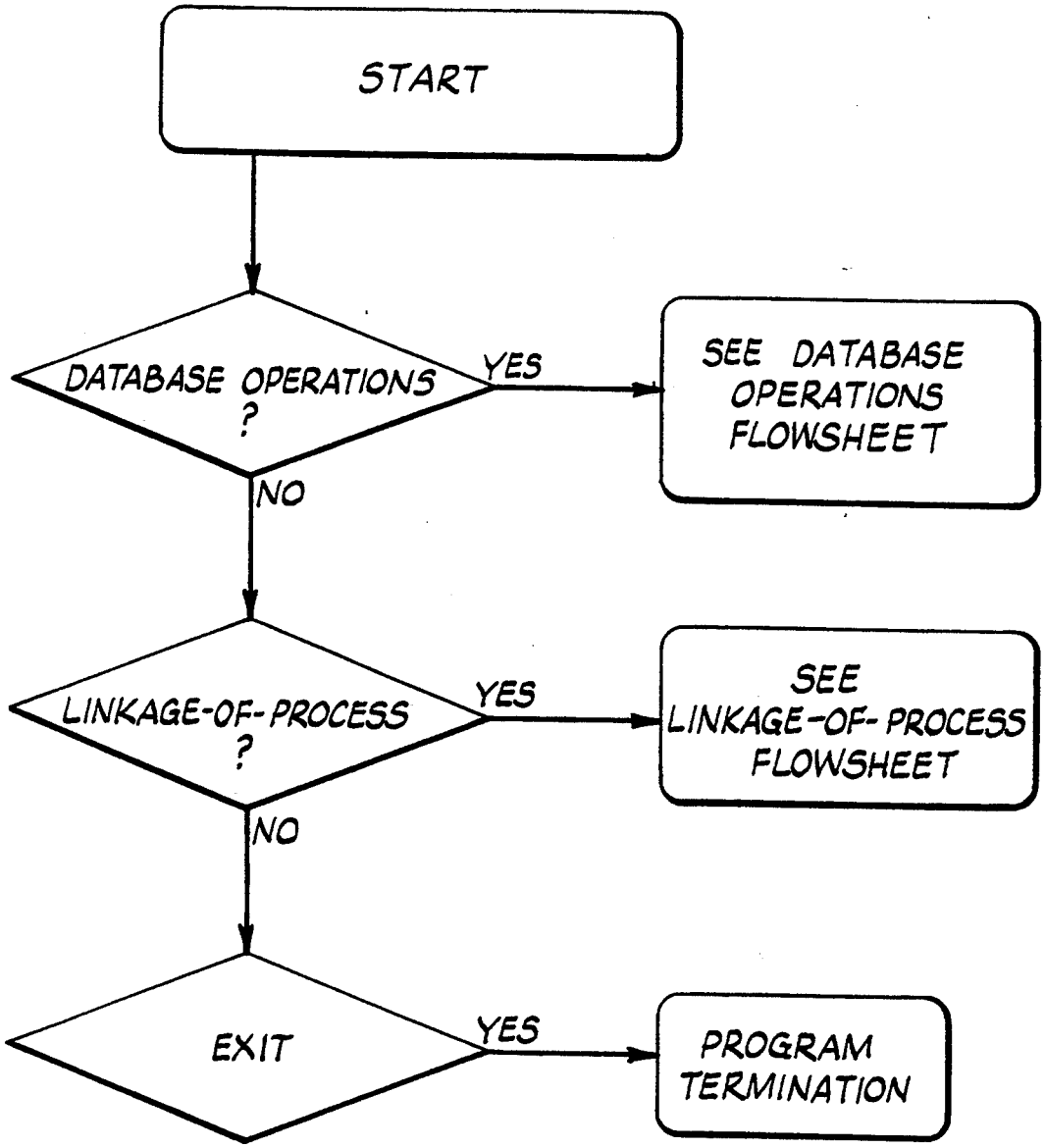
FIG. 7 is a program flow chart for a computer program used to implement the preferred embodiment method of the present invention.
Figure 8:
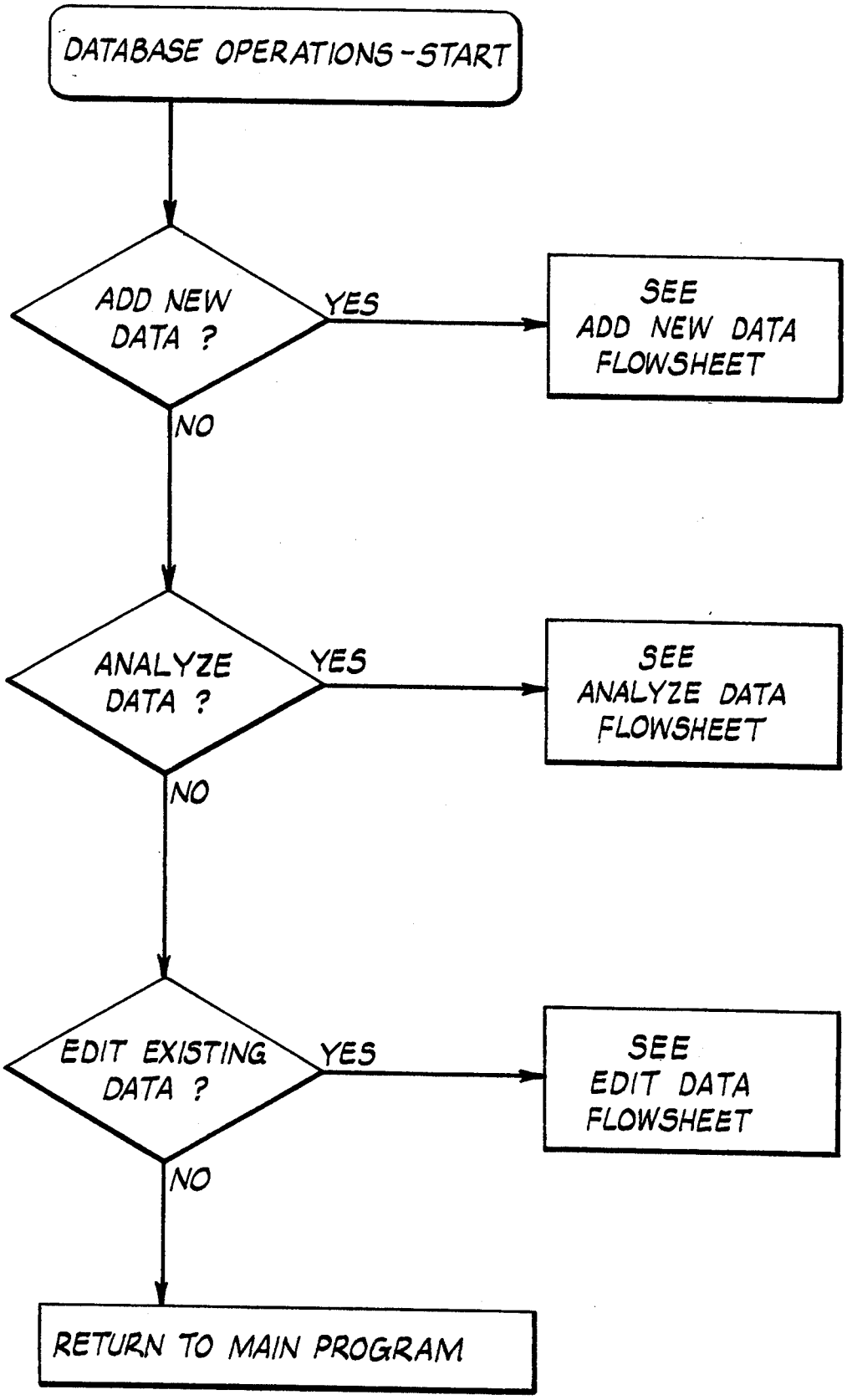
FIG. 8 is a more detailed program flow chart for a database operations portion of the flow chart of FIG. 7.
Figure 9:
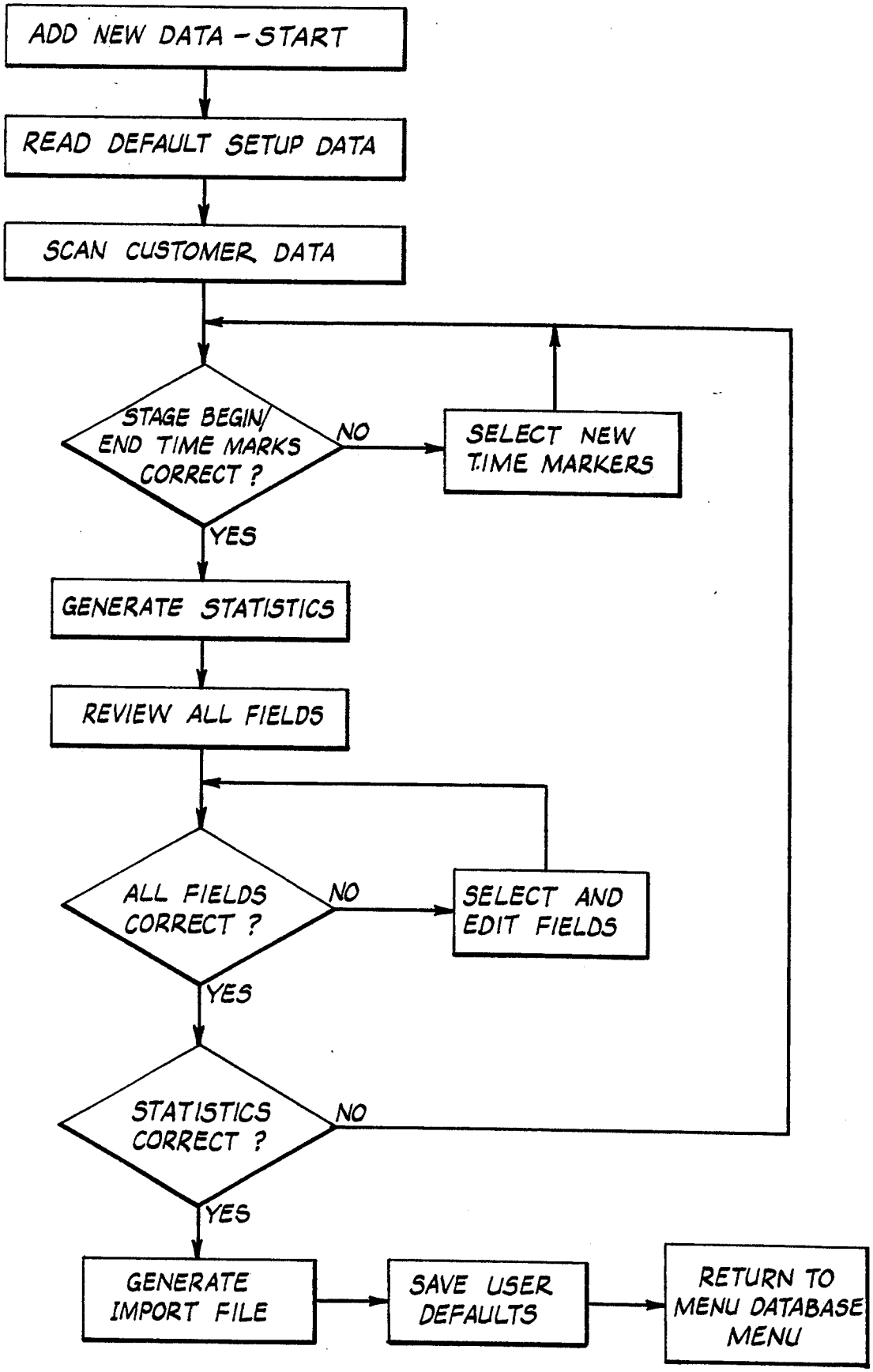
FIG. 9 is a more detailed program flow chart for an add new data portion of the flow chart of FIG. 8.
Figure 10:
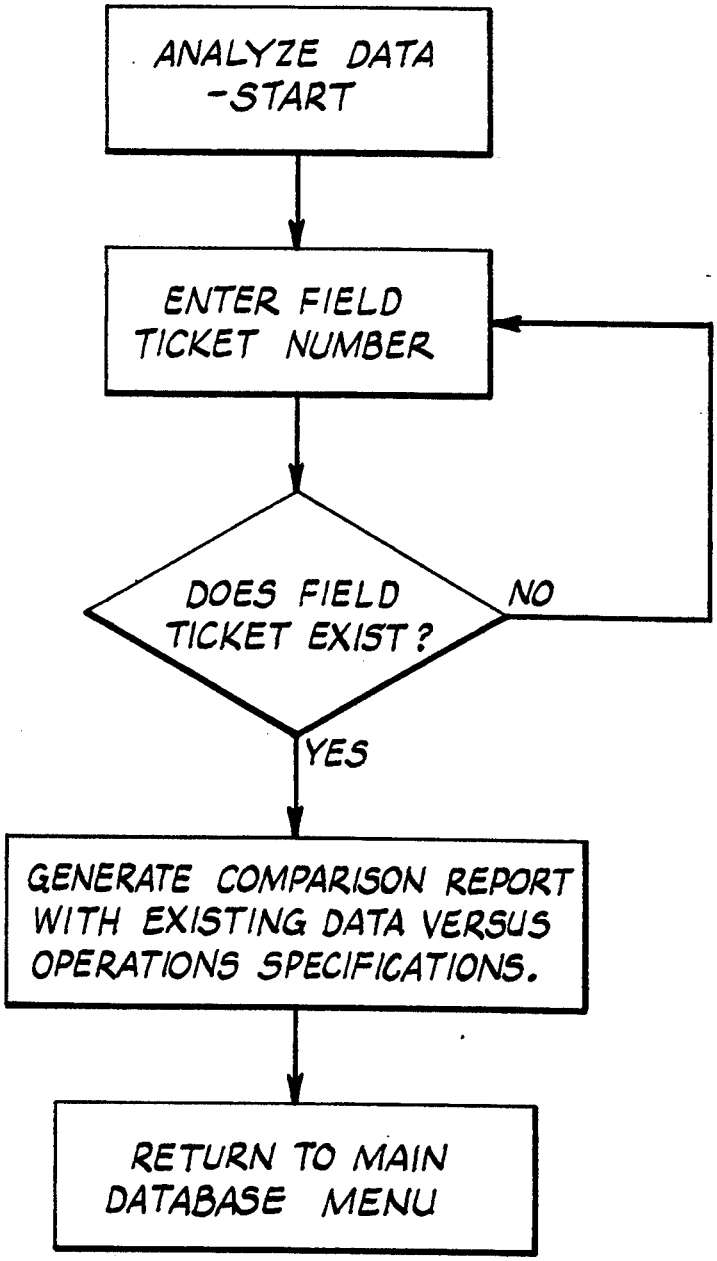
FIG. 10 is a more detailed program flow chart for an analyze data portion of the flow chart of FIG. 8.
Figure 11:
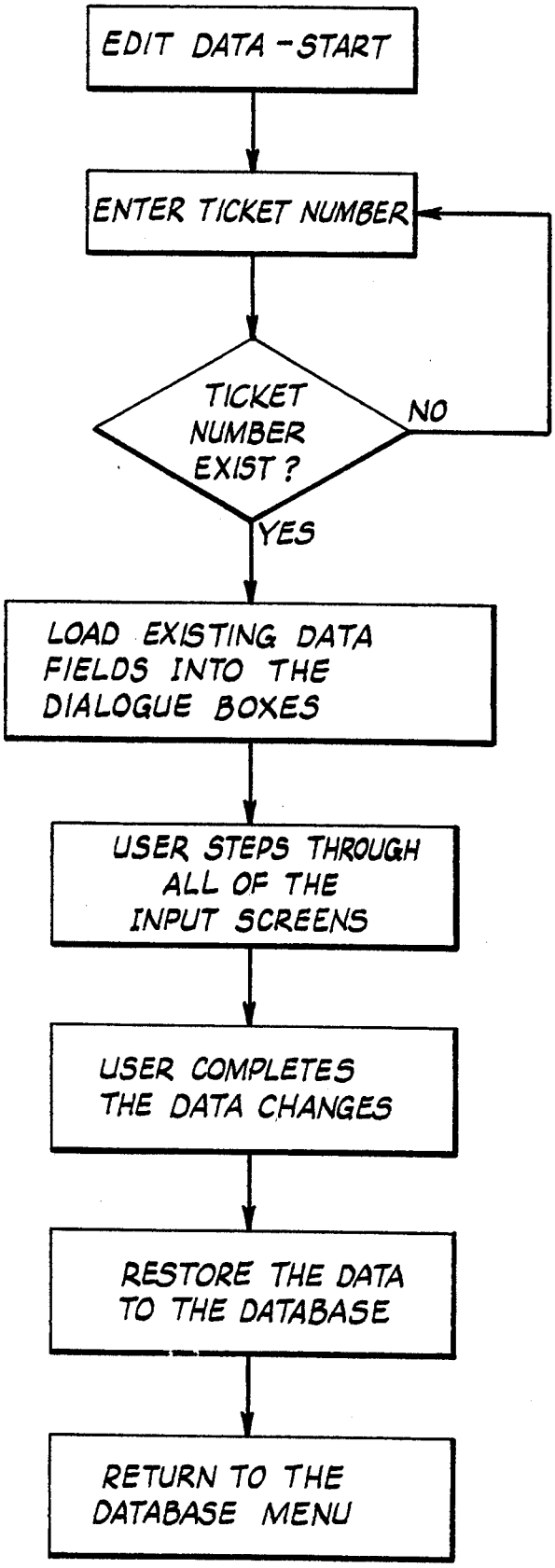
FIG. 11 is a more detailed program flow chart for an edit data portion of the flow chart of FIG. 8.

FIG. 5 explicitly shows how an identified subprocess can be further visually expressed as a flow chart. This flow chart readily defines the adjust final job procedure subprocess to those skilled in the art so that further explanation is not deemed necessary.

Abort Job (41.2.10)

The abort job subprocess of the cementing process is defined by the flow chart shown in FIG. 6. The flow chart is sufficiently self-explanatory to those skilled in the art so that further description thereof is not deemed necessary.

Further in the method of the present invention, once the subprocesses have been identified, they are expressed in a visual medium visually linking each subprocess to at least one other subprocess as illustrated in FIGS. 2–4. This step of the method can include further visually expressing subprocesses by visually representing a flow chart of steps for each subprocess, wherein each flow chart defines crucial process information (see FIGS. 5 and 6, for example). Expressing the identified subprocesses in a visual medium can include programming the computer 22 for displaying therefrom, such as via the display 26, indicia representing the linked subprocesses and the flow charts thereof in a suitable format, such as the formats shown in FIGS. 2–6 or as a listing of quality characteristics and operational definitions or as a listing of possible checks to be made or corrective actions to be taken if a problem is determined to exist (e.g., key points that can be referred to as crucial process information).

With the subprocesses of the cementing process identified and visually expressed, the method further comprises performing a particular cementing process at an oil or gas well by implementing defined subprocesses. This includes mixing a cement slurry, placing the cement slurry in the well and monitoring actual operating parameters or conditions of the performed cementing process so that electrical signals representing the monitored parameters are generated, all as known to be implemented such as by using the mixing and pumping system of FIG. 1. Typically, as known in the art, stages of cement slurry are sequentially mixed and pumped in the oil or gas well in response to the particular operating specifications that have been developed for the particular well.

In response to the electrical signals generated by the sensing or measuring devices 8, 12, 14, 16, 18 (for example) during an actual cementing process, a database 28 is created in the computer 22 for the preferred embodiment of FIG. 1. Accordingly, the database 28 includes data related to the linked subprocesses. These data preferably correspond to at least some of the quality characteristics defined in identifying the subprocesses.

To create the database, the electrical signals from the sensing or measuring devices are transformed. This includes first providing "raw" data which is the direct measurement information derived from the electrical signals. This raw data is received and stored in at least the recording device 20, which is at the well site. This raw data can be passed on to and stored in the computer 22, which is not necessarily at the well site and as presently contemplated likely is not (it is preferably at a location with which any recording device at any well location can communicate).

Further transformation occurs by statistically summarizing the raw data. This can be done locally at the well site so that only the smaller quantity of summarized data need be communicated to the computer 22, but in the preferred embodiment statistical summarization primarily is to be done in the computer 22.

To statistically summarize the stored raw data in the preferred embodiment, beginning times and ending times are defined or marked for sequential stages of slurry mixed and placed in the well. This is done, at least in part, manually at the well site. These time marks are the "event markers" represented in FIG. 1.

Statistically summarizing also includes determining averages, standard deviations, and maximum and minimum values for each measured parameter represented by raw data within each defined stage. Each average, standard deviation, maximum value and minimum value defines a respective datum to be stored in the database 28.

Each statistically summarized datum is stored in the database 28, which contains all the statistically summarized data that has been generated in accordance with the present invention. The statistically summarized data is stored in the computer 22 in a format relating to the quality characteristics of the overall process made during the step of identifying the subprocesses. In the preferred embodiment, such format is by fields representing the quality characteristics defined during such analysis. In the preferred embodiment, each datum is stored with an identifier assigned to one or more subprocesses defined in the linkage of process quality improvement analysis so that the respective datum is linked to at least one subprocess.

The method of the present invention further comprises analyzing the statistically summarized data in at least one analytical category predetermined by the linkage of process quality improvement analysis (particularly the quality characteristics thereby defined) of the cementing process wherein cement slurry is mixed and placed in an oil or gas well. One aspect of the step of analyzing the statistically summarized data in the preferred embodiment includes determining a density transition time between two stages. This determination of transition time can be accomplished using the data and event markers from respective states. Minimization of this transition time is one of the important quality improvement goals since it, along with pumping rates, determines the volume of slurry pumped that is not strictly within density specifications.

Another aspect of the step of analyzing in the preferred embodiment of the present invention is displaying, such as via the display 26, one or more selected groups of the summarized data from the database 28. Furthermore, a quantified job result report enumerating the volume percentage of each stage of the particular cementing process that had actual density within a predetermined variance (e.g., two standard deviations) of a desired density for each stage as defined in the operating specifications can be displayed. For example, the average density from the summarized data for a particular stage can be compared to the desired density for that stage as set by the operating specifications developed for the specific job.

The step of analyzing data from the database 28 can be used for determining whether any identified subprocess as actually performed is causative of a problem in the actual cementing process. If an evaluation of the defined linked subprocesses and created flow charts through analysis of data in the database 28 indicates changes are needed to the basic identification of the subprocesses, then the linked subprocesses, the flow charts, etc. can be revised. Such evaluating to determine a source of a problem can be done on any of various bases (e.g., one well, group of wells, all wells, specific types of wells, specific types of cements, specific quality characteristics), but each basis typically includes using data from the database and identifying a cementing process capability.

By way of a general example, analysis of a particular well can include identifying to the computer 22 the particular well, identifying to the computer 22 evaluation criteria to be used, and automatically comparing in the computer 22 the quality characteristics stored in the database 28 for the particular well with the identified evaluation criteria. The evaluation criteria can include specific desired parameters defined in the operating specifications for the particular cementing job at the particular well (e.g., a given value or range of values of some parameter, such as slurry density) and the evaluation criteria can also include data in the database 28 for at least one other particular oil or gas well identified to the computer 22.

Once an analysis base and evaluation criteria have been identified, the comparing can be done in two ways, for example. One way is to compare an averaged actually measured quality characteristic stored in the database 28 as a result of the data summarization versus the comparable desired characteristic entered as an evaluation criterion. For example, average density determined from an actual cementing process can be compared to the desired density designed for the job.

Another type of comparison can be made between predetermined specification limits and factors using the standard deviations determined when summarizing the data. For example, given a specification range for some measurable quantity, such as density, the capability index (CP) can be defined as the ratio between the difference of the specification limits and $6\sigma$, where $\sigma$ is the standard deviation of the relevant density measurements ($6\sigma$, the process spread, can be likened to a 99.73% confidence interval about the process mean value). If CP is greater than 1, then the process has the potential for meeting the specifications.

A similar process measure, CPK, can be used to analyze performance in terms of the targeted value of a parameter such as density. CPK is the ratio of the difference between the actual process mean value and the closest specification limit to $3\sigma$. The interpretation is that if CP has been determined to be greater than 1 and then CPK is determined to be greater than 1, then the confidence interval for the process lies inside the specification limit and the particular process is operating within the specifications. If the process is not operating within desired limits, then the previous developed information of the present invention can be used to aid in determining what details of the process need to be addressed for correcting the problem.

CP and CPK are two ways of defining the cementing process capability referred to above. From these or other suitable analytical factors, one can make meaningful evaluations about a particular job if the process at one well is being analyzed or about trends in the overall process definition and implementation if the process at several wells is being analyzed.

One aspect of implementing the foregoing method is a computer program that provides for acquiring and archiving selected quality characteristics and statistically analyzing the data to determine if subprocesses or the overall process are capable and in control. Such a program is shown in flow chart format in FIGS. 7–11, which are believed to be readily understandable to those skilled in the art in view of the foregoing description of the method of the present invention. This program uses a spreadsheet program, which is EXCEL from Microsoft Corporation in a particular implementation, but other implementations and programs can also be used (e.g., database, inference engine or word processor programs).

EXAMPLE

During a typical job, the recording device 20 records particular job data in real time. The recording device 20 has been configured during the pre-job on-site events subprocess to monitor and record real time parameters such as mix density, slurry density, pump rate, pump pressure, etc. Sometime after completion of the actually performed cementing job, the real time stored data is converted to job summary statistics by the engineering program located in the computer 22 of FIG. 1. This job data is stored in the database 28 and is ready to be used in analyzing the cementing process performed for this job. The evaluation criteria can now be identified in the computer 22 and automatically compared in the computer 22 with the quality characteristics stored in the database 28 for the particular job. From this, the performance of this job can be compared to the defined standard or defined customer requirements. The quality characteristics, process charts and linkages can be used to identify and help explain the outcome of the job based on key events that occurred during the job.

The following gives an even more specific description and example:

at the well site

1. Raw data (electronic signals every second from the different instruments) are collected and stored in a data file during the job in the "COMPUPAC" or "UNI-PRO II" recording device 20.

2. At the end of the job, the recording device 20 outputs selected raw data arrays (e.g., density versus time data for the densimeter 8) onto a 3.5-inch computer disk (for example). This data includes event markers an operator has added by observing a display at the well site and noting when changes in the respective measured parameter occur.

at the office

3. The computer disk generated in item 2 above is inserted into a drive on the computer 22.

4. The main EXCEL database computer program is then initiated on the computer 22 using the program.

5. "Database Operations" is selected (see FIG. 7).

6. "Add New Data" is selected (see FIG. 8).

7. The main computer program located on the computer 22 then searches for the data disk in a drive of the computer 22.

8. If the disk is located, the main computer program calls a subprogram which opens the disk and begins allowing the user to input additional information including the general information for identifying the well, the cement job design information that was generated before the actual job, and any additional event markers for separating the stages.

9. This subprogram will then convert the raw job data by known statistical means into the average value, the maximum value, the minimum value, and the standard deviation for each stage.

10. The subprogram generates a temporary file containing the general information, the job design information and the statistical values.

11. The main database program then adds the information in the temporary data file into the main EXCEL database as a new record.

12. Analysis can then be performed in the computer 22.

In accordance with the foregoing, assume the following design parameters for cementing a casing in a well:

50 bbls of 16.4 lb/gal lead cement stage (stage 1);
20 bbls of 16.8 lb/gal tail cement stage (stage 2);
5 bbls/min pump rate; and
system specification of +/−0.3 lb/gal.

During the pumping operation at the well site, the flow rate and the mixing cement densimeter instruments send their signals to the recording device 20 every second wherein these signals versus time define raw data stored in a file.

After the pumping operation, but still at the well site, the operator specifically selects the raw data for the densimeter 8, for example, to be transferred to a 3.5-inch disk.

The 3.5-inch disk is transferred to the district office and inserted in the appropriate disk drive of the office's computer 22.

If not inserted at the well site, a program inserts "event markers" into the disk's data file to mark the beginning and the ending of each stage. For this example, the "event markers" are:

| stage | beginning time | ending time |
|---|---|---|
| 1 | 0 seconds | 600 seconds |
| 2 | 630 seconds | 840 seconds |

The same program then statistically evaluates all of the raw data between the event markers for the first stage (lead cement). The raw data consists of approximately 600 (for example) data points of density versus time. All of these data points are evaluated using standard statistical means. The results for both stages are:

| statistical value | stage 1 | stage 2 |
|---|---|---|
| average (mean) | 16.3 lb/gal | 16.9 lb/gal |
| maximum | 16.5 | 17.0 |
| minimum | 16.1 | 16.8 |
| standard deviation | 0.2 | 0.2 |

The transition time is calculated to be 30 seconds.

All of these statistical and design data are stored in a data file on the hard drive of the computer 22. The main database program then transfers these values to the main database file as a single record.

A comparison of the stored data shows that 100% of the volume in stage 1 was within specifications and 100% of the volume in stage 2 was within specifications; however, calculation of CP shows that there is too much variability in the process.

The following shows the calculations of CP and CPK for the stage 1 cement slurry:

| | |
|---|---|
| Process spread - $6\sigma$ ($6 \times 0.2$) | 1.2 lb/gal |
| USL (upper specification limit, 16.4 + 0.3) | 16.7 lb/gal |
| LSL (lower specification limit, 16.4 − 0.3) | 16.1 lb/gal |

$$\text{Cp(capability index)} = \left| \frac{\text{USL} - \text{LSL}}{6\sigma} \right| = \frac{.6}{1.2} = 1/2$$

Since CP is less than one, the process has more variability than desired for the given specification limits and the calculated standard deviation.

Once CP has shown this, CPK would not need to be determined; but for purposes of illustration CPK, which is used to measure the performance in terms of the process center, is calculated as follows:

$$CPK = \left| \frac{\text{mean value} - \text{nearest specification limit}}{3\sigma} \right| = \frac{16.3 - 16.1}{.6} = 1/3$$

Since CPK is less than one, the process is confirmed as being too variable. If the capability index were greater than or equal to one, then CPK would become the critical parameter for determining process capability.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A method of evaluating a cementing process for an oil or gas well, comprising:

identifying subprocesses of a cementing process;

expressing the identified subprocesses in a visual medium, including visually linking each subprocess to at least one other subprocess;

performing identified subprocesses to implement an actual cementing process at an oil or gas well, including mixing a cement slurry, placing the cement slurry in the well and monitoring operating parameters of the performed subprocesses so that electrical signals representing the monitored parameters are generated;

creating in a computer a database in response to the generated electrical signals, wherein the database includes data from the actual cementing process related to the linked identified subprocesses; and analyzing data from the database for determining whether any identified subprocess as actually performed is causative of a problem in the actual cementing process.

2. A method as defined in claim 1, wherein identifying subprocesses includes selecting a mixing subprocess, a placing subprocess and a condition hole subprocess.

3. A method as defined in claim 1, wherein expressing the identified subprocesses in a visual medium further includes visually representing a flow chart of steps for each subprocess, wherein each flow chart defines crucial process information.

4. A method as defined in claim 1, wherein expressing the identified subprocesses in a visual medium further includes displaying from the computer indicia representing the linked subprocesses.

5. A method as defined in claim 1, wherein creating a database in a computer includes:

storing data representing the monitored operating parameters;

statistically summarizing the stored data; and storing the statistically summarized data in a predetermined format in the database.

6. A method of improving quality of a cementing process for oil or gas wells, comprising:

defining subprocesses of a generic cementing process for oil or gas wells, defining measurable quality characteristics of the subprocesses and defining operating specifications for a plurality of stages of a particular cementing process;

mixing and pumping stages of cement slurry at an oil or gas well in response to the defined operating specifications, including introducing the stages of cement into the well;

generating electrical signals in response to measuring actual cementing process conditions, including density, existing during the mixing and pumping of the cement slurry and corresponding to the defined measurable quality characteristics;

transforming the electrical signals into data, including defining groups of raw data in response to the electrical signals and selected time markers applied thereto and computing summarized data from the raw data within each of the defined groups; and displaying a quantified job result report enumerating the volume percentage of stages of the particular cementing process having actual density within a predetermined variance of a desired density for each stage defined in the operating specifications.

7. A method of improving quality of a cementing process for oil or gas wells, comprising:

defining subprocesses of a cementing process for oil or gas wells and defining measurable quality characteristics of the subprocesses;

mixing and pumping cement slurry at an oil or gas well, including implementing defined subprocesses in response to a predetermined operating specification so that the cement slurry is placed in the well;

generating electrical signals in response to measuring actual cementing process conditions existing during the mixing and pumping of the cement slurry and corresponding to the defined measurable quality characteristics;

transforming the electrical signals into data, including defining groups of raw data in response to the electrical signals and selected time markers applied thereto and computing summarized data from the raw data within each of the defined groups;

storing the summarized data in a database of a computer; and computing a cementing process capability in response to the stored summarized data and the predetermined operating specification.

8. A method as defined in claim 7, wherein computing a cementing process capability includes determining an index CP, wherein CP is the ratio of (1) the difference between specification limits defined in the predetermined operating specification to (2) a multiple of a standard deviation defined in the stored summarized data.

9. A method as defined in claim 7, wherein computing a cementing process capability includes determining an index CPK, wherein CPK is the ratio of (1) the difference between an actual average defined in the stored summarized data and a specification limit defined in the predetermined operating specification, which specification limit is the one closest to the actual average, to (2) a multiple of a standard deviation defined in the stored summarized data.

* * * * *